US005681038A

United States Patent [19]

Kollann et al.

[11] Patent Number: 5,681,038

[45] Date of Patent: Oct. 28, 1997

[54] APPARATUS FOR STACKING SHEETS

[75] Inventors: Rolf Kollann, Herten; Armin Kloke; Winfried Brüggen, both of Düsseldorf, all of Germany

[73] Assignee: Jagenberg Papiertechnik GmbH, Neuss, Germany

[21] Appl. No.: 550,961

[22] Filed: Oct. 31, 1995

[30] Foreign Application Priority Data

Oct. 31, 1994 [DE] Germany ..... 44 38 964.7

[51] Int. Cl.[6] ..... B65H 31/12

[52] U.S. Cl. ..... 271/218; 271/220

[58] Field of Search ..... 271/218, 220, 271/207, 214, 215, 217; 414/789.9, 790.8

[56] References Cited

U.S. PATENT DOCUMENTS

| | | | |
|---|---|---|---|
| 4,949,953 | 8/1990 | Claassen et al. | 271/218 |
| 5,102,117 | 4/1992 | Henn et al. | 271/218 X |

FOREIGN PATENT DOCUMENTS

| | | |
|---|---|---|
| 921 941 | 1/1955 | Germany . |
| 1 461 219 | 6/1969 | Germany . |
| 2 100 980 | 1/1971 | Germany . |
| 35 35 113 | 10/1985 | Germany . |
| 35 36 859 | 10/1985 | Germany . |
| 89 13 127 | 5/1989 | Germany . |
| 39 23 475 | 7/1989 | Germany . |
| 41 39 978 | 5/1993 | Germany . |

*Primary Examiner*—David H. Bollinger
*Attorney, Agent, or Firm*—Herbert Dubno

[57] ABSTRACT

An apparatus for stacking sheets has a frame defining a stacking station and a pair of substantially parallel and transversely spaced guides on the frame in the station each having a horizontal lower edge and a planar inner face turned toward the other guide. Each guide is formed with a downwardly open notch opening at the respective lower edge and housing a respective guide plate vertically displaceable between a lower position projecting below the respective lower edge and an upper position wholly above the respective lower edge. Each guide plate has an inner face substantially coplanar with the inner face of the respective guide. A vertically displaceable platform is provided in the station underneath the guides along with a support rack horizontally displaceable in the station between an extended position directly above the platform and upwardly engaging the guide plates and a retracted position not directly above the platform and out of engagement with the guide plates. A conveyor delivers a succession of sheets one after the other at a predetermined level and in a predetermined direction parallel to the guides to the station so that the sheets drop down between the guides and are deposited on the rack in the extended position thereof and on the platform in the retracted position of the rack.

8 Claims, 2 Drawing Sheets

APPARATUS FOR STACKING SHEETS

FIELD OF THE INVENTION

The present invention relates to an apparatus for stacking sheets. More particularly this invention concerns a guide system for use in an apparatus that receives sheets, for instance of thick paper or cardboard, one at a time and stacks them up on pallets.

BACKGROUND OF THE INVENTION

Paper is produced as a continuously advancing strip that is transversely cut into sheets that are typically deposited in a stacking apparatus onto pallets. The stacking apparatus typically has a vertically displaceable platform on which is supported a pallet. The sheets are delivered to the stacking apparatus to form a stack on the pallet, which is lowered as the stack height increases so that each sheet has only to drop a minimal distance before coming to rest on top of the stack.

In order to be able to unload the machine without stopping the infeed of sheets, a rack is provided that can be extended to a position above the pallet to intercept the sheets while the full pallet is being taken away and replaced with an empty one. After the new pallet is in place, the rack is retracted to deposit the short stack that has formed on it onto this new pallet and stacking continues as before. Such a system is described in German 3,535,113 of J. Bodewein.

In order to ensure that the sheets form a neat stack, with each sheet in perfect registration with the underlying sheets, side and end guides are provided. The side guides keep the side edges, that is those edges parallel to the sheet displacement direction, aligned while the end guide ensures that the sheets stop at the same position with their leading and trailing edges perfectly aligned.

Since the sheet size changes, the guides are displaceable horizontally. In addition it is known to vibrate the guides to ensure that the sheets riding thereon align perfectly. Furthermore as described in German 3,568,859 of J. Bodewein it is known to form the side guides of several parts of which at least one is movable to compensate not only for sheet size, but for vertical movement of the stack-carrying platform and German 1,461,219 describes a system where the end stops are movable vertically with the platform. Other such systems are described in German patent 921,941 of W. Koch, 2,100,980 of W. Benbenek, 3,923,475 of H. Kohlmann, 4,139,978 of U. Ganter, and utility model G 89 13 127.4.

Most of these systems work poorly at best when the temporary support rack is extended to catch the sheets while the pallet is switched. In order to accommodate this rack the side guides at least must be held somewhat up above it, making it possible for the first few sheets to get out of alignment. In fact the guides frequently are set up to stand a tiny bit above both the rack and the pallet, so that the lowermost sheets of every stack are often misaligned and must be discarded by the end user.

Alternately it is possible for sheets to get pinched between the temporary support rack and the guides, once again leading to misalignment. Even in systems where the guides are constructed to follow the pallet and/or rack, at the time of switchover there is frequently a gap between the lower edges of the guides and the support surface so that sheets get misaligned. Severe misalignment can cause sheets of one stack to be pinched between sheets of an adjacent stack, resulting in interconnected piles that are disturbed when pulled apart.

OBJECTS OF THE INVENTION

It is therefore an object of the present invention to provide an improved sheet-stacking apparatus.

Another object is the provision of such an improved sheet-stacking apparatus which overcomes the above-given disadvantages, that is which ensures accurate guiding of the continuously infed sheets even during pallet change.

SUMMARY OF THE INVENTION

An apparatus for stacking sheets has according to the invention a frame defining a stacking station and a pair of substantially parallel and transversely spaced guides on the frame in the station each having a horizontal lower edge and a planar inner face turned toward the other guide. Each guide is formed with a downwardly open notch opening at the respective lower edge and housing a respective guide plate vertically displaceable between a lower position projecting below the respective lower edge and an upper position wholly above the respective lower edge. Each guide plate has an inner face substantially coplanar with the inner face of the respective guide. A vertically displaceable platform is provided in the station underneath the guides along with a support rack horizontally displaceable in the station between an extended position directly above the platform and upwardly engaging the guide plates and a retracted position not directly above the platform and out of engagement with the guide plates. A conveyor delivers a succession of sheets one after the other at a predetermined level and in a predetermined direction parallel to the guides to the station so that the sheets drop down between the guides and are deposited on the rack in the extended position thereof and on the platform in the retracted position of the rack.

The guide plates are wholly actuated by gravity, sliding down to contact either the temporary support rack of the underlying pallet depending on which element is catching the incoming sheets. There will never be a gap between the lower edge of these plates and the support surface, and they will be deflected upward when the temporary support rack is extended in to the catching position. Even if the upper pallet surface is uneven, the guide plates will make solid contact with it.

The plates according to the invention are circular disks having centers and each guide is provided with a respective pivot secured to the respective disk for pivoting thereof between the upper and lower positions. Each pivot is upstream relative to the direction of the respective center.

More particularly each guide has a pair of transversely oppositely directed faces and is formed on each face with a respective such notch and each disk includes a pair of parts each received in a respective one of the notches and has means coupling the pair together for joint pivoting between the upper and lower positions. Each guide is formed by an unnotched center plate and a pair of outer plates each forming a respective one of the notches. Furthermore each guide is provided with a filler block fixed between the respective disks and engageable with the support rack on displacement of same into its extended position.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
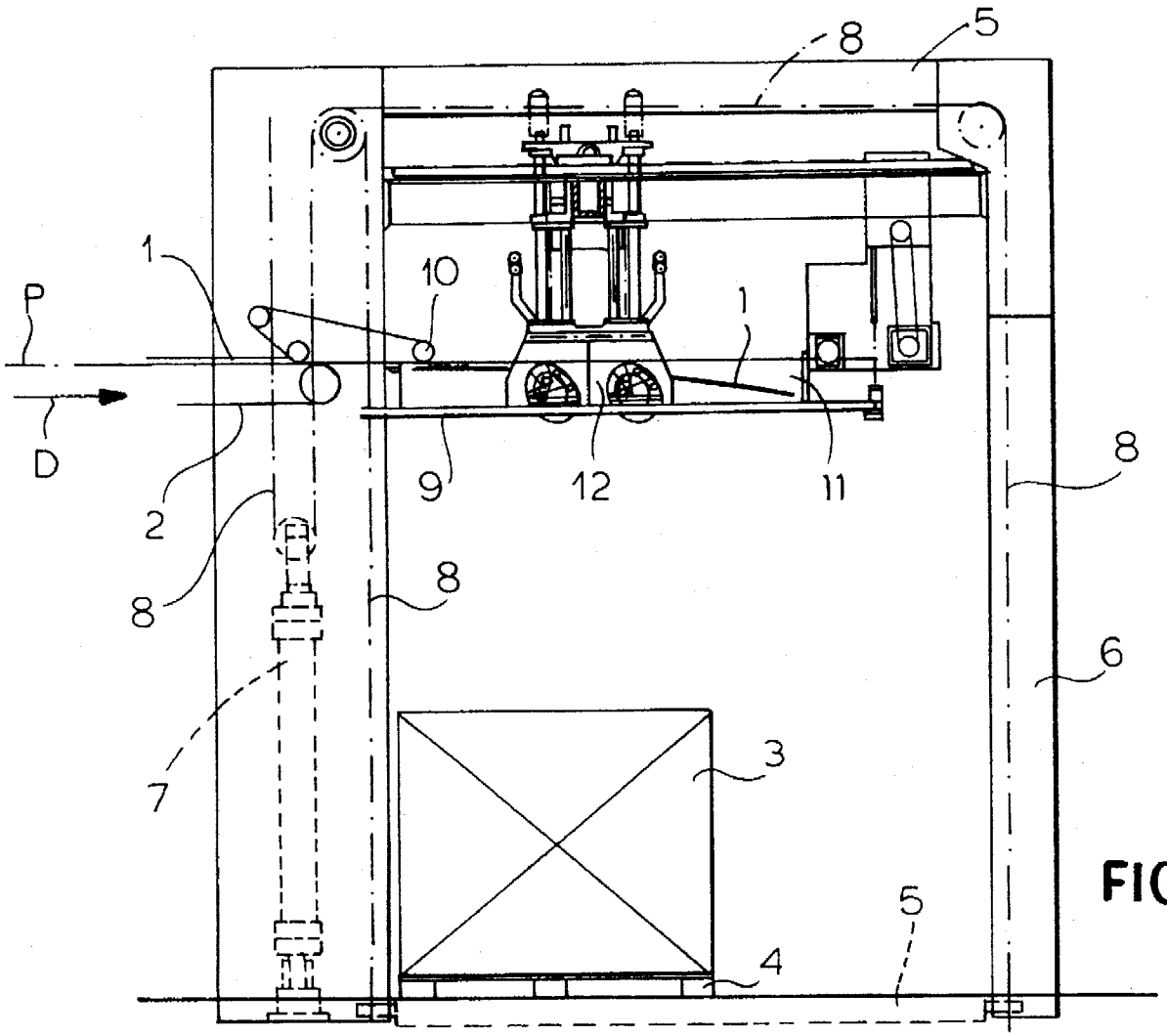
FIG. 1 is a small-scale side view of a sheet stacking apparatus according to the invention.

As seen in FIG. 1 a succession of large cardboard sheets 1 are delivered by a conveyor 2 to a sheet-stacking apparatus where they are formed into a stack 3 on a pallet 4. The pallet 4 sits on a vertically movable floor 5, so that as the stack 3 is being formed the pallet 4 can be moved vertically so that the sheets 1 do not have to drop too far before they land on the pallet 4. To this end cables 8 connected to the floor panel 5 extend up a machine frame 6 and are connected to an actuator 7 that allows the floor panel 5 to be lowered synchronously as the stack 3 is formed, with the top of the stack 3 being only slightly below a delivery plane P of the input conveyor 2.

Once the stack 3 is of the desired size a temporary support rack 9 comprised of an array of bars is displaced in the transport direction D into position above the panel 4 and below the plane P. Thus the pallet 4 carrying the stack can be lowered and switched for an empty pallet that is raised into position just underneath the rack 9 which is then retracted upstream to deposit the short stack formed during the pallet-switching operation onto this new empty pallet. This operation is all substantially standard.

Figure 3:
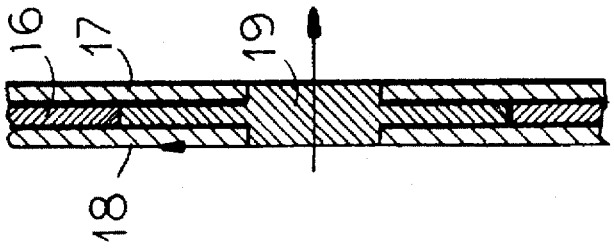
FIG. 3 is a large-scale section taken along line III—III of FIG. 2.
Figure 2:
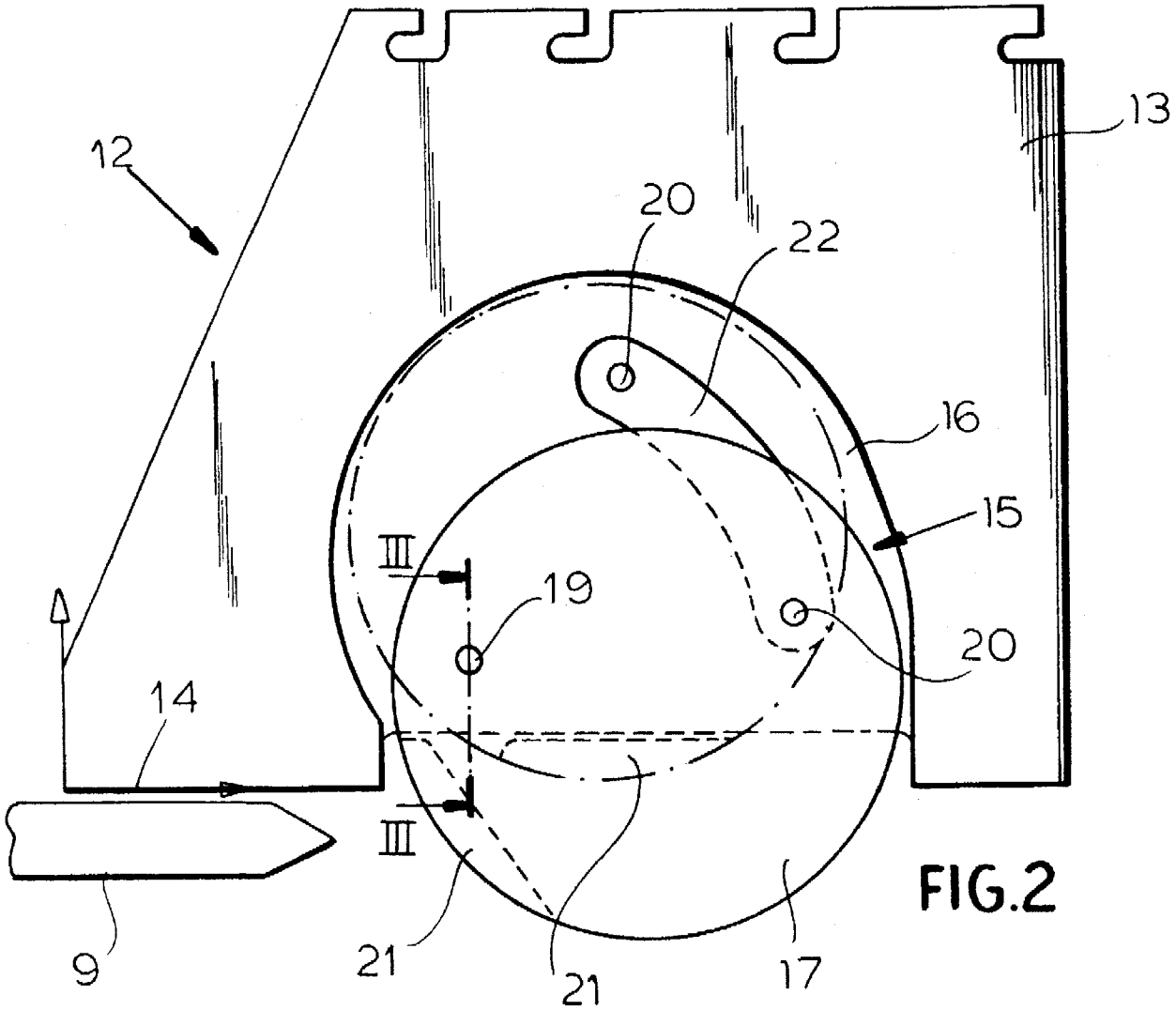
FIG. 2 is a larger-scale side view of a guide plate according to the invention.

As best seen in FIGS. 2 and 3 the frame holds a pair of planar side guides 12 each extending vertically and in the direction D and intended to keep the sheets 1 aligned with the direction D as they drop down onto the rod rack 9 or the top of the stack 3. Each of these guides 12 is formed of a center plate 16 sandwiched between a pair of outer plates 13 and has a straight lower edge 14 extending horizontally parallel to the direction D but at a level below the plane P.

The two outer side plates 13 are each formed with a downwardly open cutout or notch 15 in each of which is movable a respective vertically movable circular disk 17 or 18 of the same thickness as the respective plate 13. An offcenter pivot pin 19 extending through the center disk 16 and provided offcenter of the movable disks 17, upstream thereof in the direction D, allows these disks 17 and 18 to pivot between the lower solid-line position in which they extend some 60 mm below the lower edge 14 and an upper position in which they lie wholly above the edge 14. The disks 17 and 18 are of the same thickness as the respective plates 13 so they lie flush in the notches 15.

The center plate 16 is formed in the notches 15 with a throughgoing arcuate slot 22 centered on the axis of the pivot 19 and the two disks 17 and 18 are connected together by a pin 20 through this slot 22 so that they move jointly. In addition a small filler block 21 is provided between the two disks 17 and 18 below the pivot 12 where they would be engaged by the pointed ends of the bars of the rack 9 to prevent these bars from wedging between the disks 17 and 18.

With this system as the bar rack 9 moves into and out of position the disks 17 and 18 can pivot up out of the way, so that they always come right down to the level of the support surface and prevent a sheet i from getting canted. Similarly as the pallet 4 and its stack 3 move vertically, these disks 17 can compensate for such movement and keep in position on the sides below the top edge of the stack 3, again ensuring that the sheets 1 land square and stay square.

We claim:

1. An apparatus for stacking sheets, the apparatus comprising:

a frame defining a stacking station;

a pair of substantially parallel and transversely spaced guides on the frame in the station each having a horizontal lower edge and a planar inner face turned toward the other guide, each guide being formed with a downwardly open notch opening at the respective lower edge;

a respective vertically displaceable guide plate displaceable in each of the notches between a lower position projecting below the respective lower edge and an upper position wholly above the respective lower edge, each guide plate having an inner face substantially coplanar with the inner face of the respective guide;

a vertically displaceable platform in the station underneath the guides;

a support rack horizontally displaceable in the station between an extended position directly above the platform and upwardly engaging the guide plates and a retracted position not directly above the platform and out of engagement with the guide plates; and input-conveyor means for delivering a succession of sheets one after the other at a predetermined level and in a predetermined direction parallel to the guides to the station so that the sheets drop down between the guides and are deposited on the rack in the extended position thereof and on the platform in the retracted position of the rack.

2. The sheet-stacking apparatus defined in claim 1 wherein the plates are disks having centers, each guide being provided with a respective pivot secured to the respective disk for pivoting thereof between the upper and lower positions.

3. The sheet-stacking apparatus defined in claim 2 wherein each pivot is upstream relative to the direction of the respective center.

4. The sheet-stacking apparatus defined in claim 3 wherein each guide has a pair of transversely oppositely directed faces and is formed on each face with a respective such notch and each disk includes a pair of parts each received in a respective one of the notches and has means coupling the pair together for joint pivoting between the upper and lower positions.

5. The sheet-stacking apparatus defined in claim 4 wherein each guide is formed by an unnotched center plate and a pair of outer plates each forming a respective one of the notches.

6. The sheet-stacking apparatus defined in claim 4 wherein each guide is provided with a filler block fixed between the respective disks and engageable with the support rack on displacement of same into its extended position.

7. The sheet-stacking apparatus defined in claim 1 wherein each guide plate is substantially circular.

8. The sheet-stacking apparatus defined in claim 1 wherein the lower edges are beneath the level.

* * * * *